United States Patent [19]

Yamada et al.

[11] Patent Number: 4,679,794

[45] Date of Patent: Jul. 14, 1987

[54] GOLF BALL

[75] Inventors: Mikio Yamada, Kobe; Akihiko Hamada, Kakogawa, both of Japan

[73] Assignee: Sumitomo Rubber Industries, Ltd., Hyogo, Japan

[21] Appl. No.: 795,129

[22] Filed: Nov. 5, 1985

[30] Foreign Application Priority Data

Nov. 5, 1984 [JP] Japan ..... 59-233498

[51] Int. Cl.[4] ..... A63B 37/12; A63B 43/06

[52] U.S. Cl. ..... 273/235 R; 273/DIG. 22

[58] Field of Search ..... 273/235 R, 218, 235 A, 273/235 B, 232, 233, 234, 60 B

[56] References Cited

U.S. PATENT DOCUMENTS 3,647,221 3/1972 Holley ..... 273/235 A 4,141,559 2/1979 Melvin et al. ..... 273/235 R

FOREIGN PATENT DOCUMENTS 2144045A 2/1985 United Kingdom ..... 273/235 R

*Primary Examiner*—George J. Marlo

*Attorney, Agent, or Firm*—Birch, Stewart, Kolasch & Birch

[57] ABSTRACT

There is provided a golf ball having excellent whiteness, comprising a core and a cover wrapping said core. The cover comprises 100 parts by weight of an ionomer resin, 1 to 10 parts by weight of an inorganic white pigment containing barium sulfate having a particle size of 1 to 10 μm in the amount of not less than 60% by weight, 0.0001 to 0.05 parts by weight of a blue coloring agent and 0.01 to 0.4 parts by weight of a fluorescent whitening agent. The cover may be coated first with clear epoxy, and second with clear urethane.

7 Claims, 2 Drawing Figures

GOLF BALL

FIELD OF THE INVENTION

The present invention relates to a golf ball, and more particularly, to a wound or two-piece golf ball covered by a thermoplastic resin such as ionomer resin and the like.

BACKGROUND OF THE INVENTION

A wound or two-piece golf ball covered by a thermoplastic resin such as ionomer resin and the like containing white pigments such as titanium oxide and the like in the cover in order to make the golf ball white, has been made. However, a satisfactory white color has not been obtained by such white pigments. When a conventional urethane clear paint was coated on the cover, the whiteness of cover drops and its appearance becomes dull in comparison with a golf ball which is not coated by the clear paint. In addition, it is not desirable for a golf ball to have a urethane clear paint applied onto the resin cover, because the adhesion between the cover and the urethane clear coating is weak, which brings about the peeling of the coating.

For obtaining a good white colored golf ball, white paint is coated on its cover. However, such a golf ball eventually begins to have poor appearance when the golf ball is hit by iron clubs and the coating is damaged, such as the peeling of the coating to result in its cover surface coming out which does not have satisfactory white color as mentioned above.

SUMMARY OF THE INVENTION

The present invention provides a golf ball in which it is not necessary to have a white coating layer. The golf ball comprises a core and a cover wrapping the core. The cover comprises 100 parts by weight of an ionomer resin, 1 to 10 parts by weight of an inorganic white pigment containing barium sulfate having a particle size of 1 to 10 μm in an amount of not less than 60% by weight, 0.0001 to 0.05 parts by weight of a blue coloring agent and 0.01 to 0.4 parts by weight of a fluorescent whitening agent.

Further scope of applicability of the present invention will become apparent from the detailed description given hereinafter. However, it should be understood that the detailed description and specific examples, while indicating preferred embodiment of the invention, are given by way of illustration only, since various changes and modifications within the spirit and scope of the invention will become apparent to those skilled in the art from this detailed description.

DETAILED DESCRIPTION OF THE PRESENT INVENTION

Figure 1:
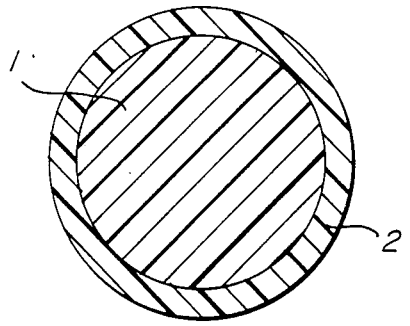

In the present invention, the ionomer resin is preferably a thermoplastic resin obtained by giving a cross metallic bond to polymers of monoolefin with at least one member selected from the group consisting of unsaturated mono- or di-carboxylic acids and an ester therefrom. Preferred is a thermoplastic resin obtained by giving a cross metallic bond to polymers of monoolefin with at least one member selected from the group consisting of unsaturated mono- or di carboxylic acids having 3 to 8 carbon atoms and an ester therefrom.

The ionomer resin may contain other resins, such as nylon, polyester, polyurethane and the like. The amount of the other resins is up to 20 parts by weight based on 100 parts by weight of the ionomer resin. Preferred ionomer resins are Surlyn 1605, 1707, 1706 and the like, available from Du Pont Co.

According to the present invention, not only a white pigment but also a blue coloring agent and a fluorescent whitening agent are added to the ionomer resin mentioned above. The sole addition of the white pigment, such as rutile and anatase type titanium oxide, makes the golf ball slightly yellowish and therefore it has to be coated by a white paint.

As white pigments, titanium oxide and others have been employed for a long time, but these pigments do not give satisfactory whiteness to the golf ball. A large amount of use of such pigments tinges the golf ball with yellow, and this use in large amounts adversely affects the physical properties of the ball. These white pigments can be combined with blue coloring agents, but such a combination does not provide sufficient whiteness. It can be possible to formulate whitening agents with the white pigments, which improves its whiteness a little, but the improvement is not sufficient in golf balls.

The inorganic white pigment to be formulated in the ionomer resin can be white pigments containing barium sulfate having a particle size of 1 to 10 μm in the amount of not less than 60% by weight.

Barium sulfate has been employed as a white pigment for golf balls for long time. The barium sulfate used for this purpose had a particle size of 0.1 to 0.2 μm. It is difficult for such small particles to be formulated into resin compositions, thus mixing is not carried out uniformly. A large amount of use of these particles is often a source of fatigue destruction of golf balls. Accordingly, this type of barium sulfate has not been used in marketed articles.

According to the present invention, the barium sulfate has a particle size of 1 to 10 μm and this barium sulfate is combined with the other inorganic pigment in the amount of not less than 60% by weight, preferably 70 to 95% by weight, based on the total amount of the inorganic pigment. Such a large sized particle of barium sulfate enhances the whitening effect of the fluorescent whitening agent and lowers the amount of the fluorescent whitening agent, which is expensive. The appearance of the final golf ball can also be improved to be more "white". In addition, barium sulfate having this particle size can be easily mixed with the cover resin and can provide a uniform mixture.

The other inorganic white pigments of the present invention include titanium oxide, barium sulfate having 0.1 to 0.2 μm, aluminum silicate, zinc sulfide, clay and the like. Preferred are a combination of titanium oxide with barium sulfate. This white pigment can be employed in the amount of 1 to 10 parts by weight, preferably 5 to 9 parts by weight based on 100 parts of the ionomer resin. Amounts less than 1 part by weight are undesirable because of insufficient whiteness, and amounts of more than 10 parts by weight are undesirable because of low rebound elasticity. According to the present invention, the blue coloring agent and the fluorescent whitening agent are combined with the white pigment mentioned above. When the fluorescent whitening agent is solely added to the cover, the color of cover is slightly tinged with yellow. When the blue coloring agent is used alone, the gloss of the cover becomes insufficient.

The blue coloring agent used in the present invention is not particularly limited. Examples of the blue coloring agent are ultramarine blue, Milori blue, iron blue, cobalt blue, cerulean blue, fast sky blue, phthalocyanine blue and the like. The amount of the blue coloring agent is 0.0001 to 0.05 parts by weight, preferably 0.001 to 0.01 parts by weight, based on 100 parts by weight of the ionomer resin. Amounts of less than 0.0001 parts by weight are undesirable, because blueness and whiteness is insufficient to result in a ball looking yellowish white. Amounts of more than 0.05 parts by weight are also undesirable, because blue becomes conspicuous and it turns a different color from white.

The fluorescent whitening agent of the present invention is not particularly limited, and as its examples, 2,5-bis(5'-t-butylbenzooxazolyl (2))tiophen (available from Japan Chiba Geigy Co. as UVITEX OB), UVITEX OB-P (available from Japan Chiba Geigy Co.), white flour HCS, PCS, B (available from Sumitomo Chemical Co.) are given. The amount of fluorescent whitening agent is 0.01 to 0.4 parts by weight, preferably 0.05 to 0.2 parts by weight, based on 100 parts by weight of the ionomer resin. Amounts of less than 0.01 do not give a sufficient whitening effect, and the amounts of more than 0.4 parts by weight are not economical, because a rise in the whitening effect is not observed. In addition, the charge of a large amount adversely affects the durability of cover.

The ionomer resin cover of the present invention may contain conventional additives, such as a metal salt of a higher fatty acid for facilitating mixing of the coloring agent or the pigments including the fluorescent whitening agent. The amount of the metal salt of a higher fatty acid is preferably 0.0001 to 0.001 parts by weight based on 100 parts by weight of the ionomer resin.

The golf ball of the present invention is generally subjected to a clear coating. The clear coating is preferably conducted by applying an epoxy clear paint on the cover and then applying a urethane clear paint thereon. When the cover was directly coated with the urethane clear paint, the peeling of the coating easily occurs by means of the impact from clubs and the surface of golf ball becomes rough after being damaged by ultraviolet rays. Accordingly, the epoxy clear paint, which has great adhesion to the ionomer resin cover, is coated on the cover and then the urethane clear paint, which has good impact resistance and weather resistance, is coated thereon. The epoxy clear paint is preferably used by purifying for coating, because it has been colored to light brown if not used by purifying. The clear paints may contain an ultraviolet absorber. Preferred epoxy paint may be prepared from a bisphenol A type resin and a polyamide curing agent synthesized from a highly purified dimer acid. Examples of the dimer acids are linolenic acid dimer which is prepared from 9,12-linolenic acid and 9,11-linolenic acid. The polyamide curing agent is produced by reacting the dimer acids with polyamines.

In this context, by the highly purified dimer acid is meant one sufficiently purified to contain dimer acids in the amount of not less than 90% by weight and monomer acids in the amount of not more than 1.5% by weight. In the preparation of the dimer acid mentioned above, various by-products such as trimer acids or unreacted monomers are associated with the dimer acid. Accordingly, the conventional dimer acid usually contains dimer acids of not less than 75% by weight, the trimer acids of about 20% by weight and the monomer of about 5% by weight. The conventional dimer acid may cause the coloring of the clear paint, because the reaction of the dimer acid with polyamine can not proceed equivalently to produce low molecular weight additives which is easily acidized.

The purification process of the dimer acid can be carried out by hydrogenating the dimer acid.

The color number of paint is not more than 4 (a conventional one has a color number of about 8), if desirable.

The golf ball of the present invention can be either a wound golf ball or a two-piece golf ball.

FIG. 1 illustrates cover 2 wrapped around core 1.

Figure 2:
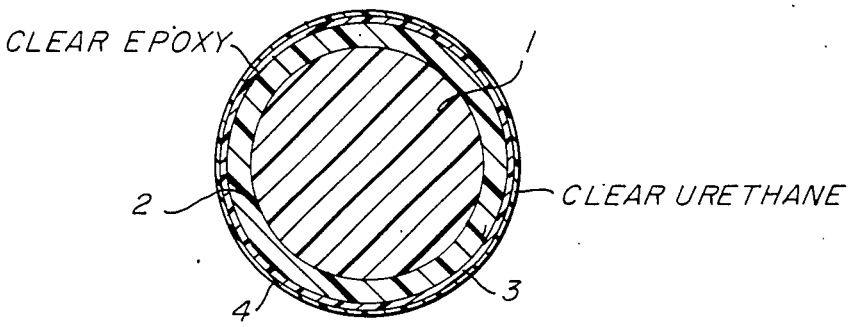

FIG. 2 illustrates a cross-sectional view of a golf ball cover cover 2 wrapped around core 1, in which cover 2 is coated with epoxy clear paint coating 3 and in which epoxy clear paint coating 3 is coated with urethane clear paint coating 4.

The present invention is illustrated by the following examples, which, however, is not to be construed as limiting the invention to their details.

EXAMPLES 1 AND 2 AND COMPARATIVE EXAMPLES 1 TO 5

A golf ball cover composition was mixed from the cover charge described in Table 1 and then injection-molded to the solid core of the golf ball. The resultant golf ball was subjected to a paint pre-treatment, such as a blast treatment, a plasma treatment, an acid treatment and the like, followed by coating it with the paint indicated in Table 1. The appearance of the ball, the degree of durability of the ball and the paint durability exposed outside for one month were measured.

The color hue of surface was measured by a Hunter colorimeter. The durability of ball was evaluated by the number of collisions aganst an iron wall at 45 m/sec until the ball was cracked. The durability of the paint was evaluated by a number of collisions againat an iron wall at 45 m/sec until the paint was peeled. The results are shown in Table 1.

The same tests were applied to a ball containing solely a white pigment, a ball solely containing a blue pigment, a ball solely containing a fluorescent whitening agent and a ball containing barium sulfate having a small particle size, as generally described in above. The charge of the cover composition and the result of the test are shown in Table 1.

In Table 1, Examples 1 and 2 represent the present invention, Comparative Example 1 represents prior art and Comparative Examples 2–5 represent comparisons with the present invention.

TABLE 1

| | | Example | | Comparative Example | | | | |
|---|---|---|---|---|---|---|---|---|
| | | 1 | 2 | 1 (prior art) | 2 | 3 | 4 | 5 |
| Cover charge | Surlyn 1706 | 50 | 50 | 50 | 50 | 50 | 50 | 50 |
| | Surlyn 1605 | 50 | 50 | 50 | 50 | 50 | 50 | 50 |
| | Titanium oxide*[1] | 1 | 2 | 2 | 2 | 4 | 12 | 2 |
| | Barium sulfate | 3*[2] | 6*[2] | | | | | 6*[3] |
| | Ultramarine blue | 0.002 | 0.003 | | | 0.002 | | 0.002 |

TABLE 1-continued

| | | Example | | Comparative Example | | | | |
|---|---|---|---|---|---|---|---|---|
| | | 1 | 2 | 1 (prior art) | 2 | 3 | 4 | 5 |
| | Calcium stearate | 0.0001 | 0.0001 | 0.001 | 0.001 | 0.001 | 0.001 | 0.0001 |
| | UVITEX OB | 0.05 | 0.1 | | 0.003 | | 0.6 | |
| Paint | Epoxy type (non-enamel)*4 | First coat | First coat | | | First coat | First coat | First coat |
| | White epoxy type | | | First coat | | | | |
| | White urethane type | | | Second coat | | | | |
| | Urethane type (non-enamel) | Second coat | Second coat | Third coat | First and Second coat | Second coat | Second coat | Second coat |
| Ball's appearance | | Glossy white | Glossy white | Glossy white | Slightly yellowish white | Slightly dull | Slightly dull | Slightly dull |
| Durability index of ball | | 100 | 99 | 97 | 98 | 99 | 83 | 85 |
| Paint durability after the exposure of one month | | Good | Good | Good | Completely peeled | Good | Good | Good |

*1A white pigment having an average particle size of 0.18 μm, available from Du Pont Co., as "TI-PURE R101".
*2A characteristic precipitated barium sulfate having an average particle size of 4 μm, available from Sakai Chemical Industry Co., Ltd.
*3A precipitated barium sulfate having an average particle size of 0.1 μm, available from Sakai Chemical Industry Co., Ltd.
*4An epoxy type paint using dimer acid containing monomer acid in an amount of not more than 1% by weight, available from Shinto Paint Co., as "POLIN #720 clear". Its color number is 3 to 4.

The golf ball obtained from the present invention has excellent appearance and good adhesion to the clear paint. The golf ball containing merely a white pigment has a light yellow color. When the white pigment is used in a large amount, it reduces the durability. The golf ball containing merely a whitening agent makes the ball light yellow in a small amount. When the whitening agent is used in a large amount, it makes the ball lower in durability. The golf ball containing a blue pigment in the cover lacks gloss. If the urethane clear paint is solely used, the resultant paint layer is easily peeled off.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A golf ball having an excellent white appearance without any white paint layers disposed on the cover, which comprises a core with a cover thereon, said cover containing 100 parts by weight of an ionomer resin, 1 to 10 parts by weight of an inorganic white pigment containing barium sulfate having a particle size of 1 to 10 micrometers said barium sulfate being present in an amount of not less than 60% by weight, based on the total amount of the inorganic white pigment, 0.0001 to 0.05 parts by weight of a blue coloring agent and 0.01 to 0.4 parts by weight of a fluorescent whitening agent, the weight of said blue coloring agent and said fluorescent whitening agent being based on 100 parts by weight of the ionomer resin.

2. The golf ball of claim 1 wherein the cover is coated with an epoxy clear paint which in turn is coated with a clear urethane clear paint.

3. The golf ball of claim 1 wherein the barium sulfate is present in an amount of 70 to 95% by weight.

4. The golf ball of claim 3 wherein the remainder of the inorganic white pigment comprises titanium oxide, barium sulfate having a particle size of 0.1 to 0.2 micrometer, aluminum silicate, zinc sulfide, clay or a mixture thereof.

5. The golf ball of claim 4 wherein the remainder of the inorganic white pigment comprises titanium oxide.

6. The golf ball of claim 1 wherein the blue coloring agent is present in an amount of 0.001 to 0.01 parts by weight.

7. The golf ball of claim 1 wherein the fluorescent whitening agent is present in an amount of 0.05 to 0.2 parts by weight.

* * * * *